US010139103B2

(12) United States Patent
Gong et al.

(10) Patent No.: US 10,139,103 B2
(45) Date of Patent: Nov. 27, 2018

(54) CEILING MOUNTED AIRWAY DEVICE WITH ILLUMINATION

(71) Applicants: Panasonic Ecology Systems Guangdong Co., Ltd., Guangdong (CN); Panasonic Ecology Systems Co., Ltd., Aichi (JP)

(72) Inventors: Wentian Gong, Guangdong (CN); Decong Yang, Guangdong (CN); Bodong Zhong, Guangdong (CN); Naoyuki Funada, Aichi (JP); Soma Hara, Aichi (JP)

(73) Assignees: PANASONIC ECOLOGY SYSTEMS GUANGDONG CO., LTD., Guangdong (CN); PANASONIC ECOLOGY SYSTEMS CO., LTD., Aichi (JP)

( * ) Notice: Subject to any disclaimer, the term of this patent is extended or adjusted under 35 U.S.C. 154(b) by 0 days.

(21) Appl. No.: 15/623,554

(22) Filed: Jun. 15, 2017

(65) Prior Publication Data

US 2018/0023803 A1 Jan. 25, 2018

(30) Foreign Application Priority Data

Jul. 19, 2016 (CN) ..... 2016 2 0768754 U

(51) Int. Cl.

| | |
|---|---|
| ***F21V 33/00*** | (2006.01) |
| ***F21V 23/06*** | (2006.01) |
| ***F21V 3/00*** | (2015.01) |
| ***F21V 19/00*** | (2006.01) |
| ***F24F 13/078*** | (2006.01) |

(52) U.S. Cl.

CPC ..... *F21V 33/0096* (2013.01); *F21V 3/00* (2013.01); *F21V 19/006* (2013.01); *F21V 23/06* (2013.01); *F24F 13/078* (2013.01)

(58) Field of Classification Search

CPC .... F21V 33/0096; F21V 19/006; F21V 23/06; F21V 3/00; F24F 13/078

See application file for complete search history.

(56) References Cited

U.S. PATENT DOCUMENTS 5,664,872 A * 9/1997 Spearman ..... F21V 33/0096 362/96

9,022,622 B2 5/2015 Craw et al.

* cited by examiner

*Primary Examiner* — David V Bruce

(74) *Attorney, Agent, or Firm* — RatnerPrestia

(57) ABSTRACT

A ceiling mounted airway device with illumination, which includes a main housing, a lamp and a lamp fixing part to detachably fix the lamp to an inner wall of the main housing. The main housing includes: a first opening for exhausting air out of the main housing; and a second opening for sucking air into the main housing. The lamp includes: an electrically conductive contact terminal located at an upper end of the lamp and electrically powered via the lamp fixing part; and a flange protruding from a surface of the lamp and located below the electrically conductive contact terminal. The device further includes a shield for supporting the flange which is substantially in form of a cylinder and surrounds the electrically conductive contact terminal and the lamp fixing part.

18 Claims, 13 Drawing Sheets

CEILING MOUNTED AIRWAY DEVICE WITH ILLUMINATION

CROSS-REFERENCE TO RELATED APPLICATION

This application claims the benefit of Chinese Patent Application No. 201620768754.6 filed on Jul. 19, 2016 in the State Intellectual Property Office of China, the whole disclosure of which is incorporated herein by reference.

BACKGROUND OF THE INVENTION

Field of the Invention

The present disclosure relates to a ceiling mounted airway device with illumination.

Description of the Related Art

In order to achieve a ventilating function and a lighting function simultaneously, there is generally provided a lighting fixture (lamp) and a blower in a ceiling mounted airway device with illumination in the prior art. It will be specifically described taking U.S. Pat. No. 9,022,622 as an example.

FIG. 1 is a schematic view of a well-known technique. As shown in FIG. 1, a conventional ceiling mounted ventilation fan with illumination 100 includes a frame 101, a blower 103 disposed in a frame 101, a lamp 104 provided with an electrically conductive contact terminal 108 on the top, and a lamp fixing part 120 which detachably fixes the lamp 104 to an inner wall of the frame 101. The frame 101 includes an air outlet 105 and an air inlet 106. Air inside the room enters the frame 101 through the air inlet 106 and then enters the blower 103 and is exhausted to outdoor through the air outlet 105, when the conventional ceiling mounted ventilation fan with illumination 100 is in operation.

The lamp 104 is mounted in the frame 101 by inserting the electrically conductive contact terminal 108 on the top of the lamp 104 into the lamp fixing part 120 provided on the frame 101. The lamp 104 has a reflector 107 surrounding the lamp 104. The reflector 107 is in a form of a substantially hollow frusto-conical shape. In addition, a length of the reflector 107 is set to be larger or be equal to the overall length of the side of the lamp 104 disposed inside the reflector. The reflector 107 reflects the light emitted from the lamp 104 into the room through the air inlet 106.

The ceiling mounted ventilation fan with illumination 100 sucks air from the inside of the room, while water or dust accompanying with the air may pass through the air inlet 106 and the inside of the reflector 107 and enter a gap between the electrically conductive contact terminal 108 and the lamp fixing part 120. As such, the water will come into contact with live parts or the dust will be carried into live parts, which may cause a short circuit.

Further, in a case that the lamp 104 is to be mounted, it is necessary to insert its electrically conductive contact terminal 108 into the lamp fixing part 120 in the frame 101 and rotate the lamp 104 by an angle such that the lamp 104 is mounted in the frame 101. In a case that the user simply inserts the lamp 104 without rotating the lamp 104 by a preset angle, it will result in that the electrically conductive contact terminal 108 of the lamp 104 and the lamp fixing part 120 of the frame 101 are not fully connected to each other. In a state of poor connection, the electrically conductive contact terminal 108 is likely to be released from the lamp fixing part 120 after the user withdraws his hand, resulting in falling down of the lamp 104.

SUMMARY OF THE INVENTION

An aspect of the present disclosure provides a ceiling mounted airway device with illumination which may prevent water from contacting live parts or dust from being carried into live parts, and prevent the lamp from falling down.

According to an aspect of the present invention, there is provided a ceiling mounted airway device with illumination, comprising a main housing, a lamp and a lamp fixing part intended to detachably fix the lamp to an inner wall of the main housing, wherein the main housing comprises:

a first opening for exhausting air out of the main housing; and a second opening for sucking air into the main housing, and the lamp comprises:

an electrically conductive contact terminal which is located at an upper end of the lamp and electrically powered via the lamp fixing part; and a flange protruding from a surface of the lamp and located below the electrically conductive contact terminal, wherein the ceiling mounted airway device with illumination further comprises a shield for supporting the flange, which is substantially in form of a cylinder and surrounds the electrically conductive contact terminal and the lamp fixing part.

According to an embodiment, an upper end and a lower end of the shield respectively form an upper end opening and a lower end opening, an inner diameter of the shield is larger than an outer diameter of the flange of the lamp, the lower end opening of the shield is provided below the flange of the lamp, and the shield is provided with a support structure for supporting the flange of the lamp.

According to an embodiment, the flange is annular.

According to an embodiment, a central axis of the shield coincides with an central axis of the lamp.

According to an embodiment, the flange of the lamp is located below the lamp fixing part and the lower end opening of the shield is located below the flange of the lamp, a light emitting part of the lamp is located at a lower end of the lamp, and the lower end opening of the shield is located above the light emitting part.

According to an embodiment, the support structure is integrally formed with the shield, and the support structure comprises an elastic tab projecting from the lower end of the shield or from a middle part of an inner wall of the shield toward the inside of the shield and extending downwardly in a height direction of the shield, a lower end of the elastic tab is provided with a hook projecting toward the inside of the shield.

According to an embodiment, a lateral surface of the shield is provided with a recess recessed toward the outside of the shield, the support structure is integrally formed with the shield, and the support structure comprises an elastic tab projecting downward from an upper part of an inner wall of the recess in a height direction of the shield, a lower end of the elastic tab is provided with a hook projecting toward the inside of the shield, the elastic tab is elastically deformable to move towards the recess so as to be received therein.

According to an embodiment, the hook is located below the flange of the lamp, and configured to be made contact with the flange of the lamp or spaced apart from the flange of the lamp by a certain distance in a vertical direction.

According to an embodiment, the hook comprises a guide surface extending from a lower end to an upper end thereof and inclined toward the inside of the shield.

According to an embodiment, an upper end of the hook is configured to be made contact with the flange of the lamp.

According to an embodiment, the number of the elastic tab is at least two, and the number of the recesses is equal to that of the elastic tab.

According to an embodiment, the number of the tab is two, and the two elastic tabs are arranged symmetrically with respect to a central axis of the shield.

According to an embodiment, the ceiling mounted airway device with illumination further comprises a blower for directing air from the second opening to the first opening.

According to an embodiment, the first opening is in communication with the outdoor through a duct.

According to an embodiment, the main housing comprises a light shielding plate for covering the first opening and a light shielding plate fixing part for fixing the light shielding plate.

The present disclosure has advantages as follows: it prevents the lamp from falling down to be damaged and improves the product safety and further prevents dust or water from entering into or being in contact with live parts, thereby avoiding short circuit and ensuring normal operation.

BRIEF DESCRIPTION OF THE DRAWINGS

The above and other features of the present disclosure will become more apparent by describing in detail exemplary embodiments thereof with reference to the accompanying drawings, in which.

DETAILED DESCRIPTION OF PREFERRED EMBODIMENTS OF THE INVENTION

Figure 1:
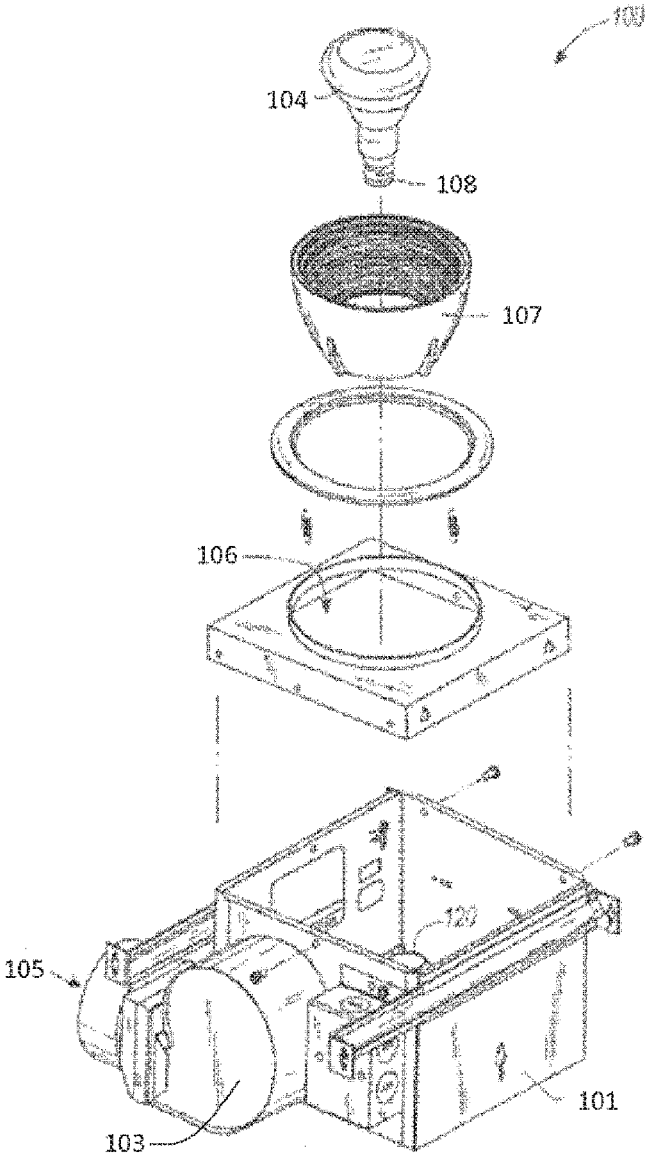
prior art Fig. 1
FIG. 1 is a schematic view of a conventional ceiling mounted airway device with illumination.
Figure 2A:
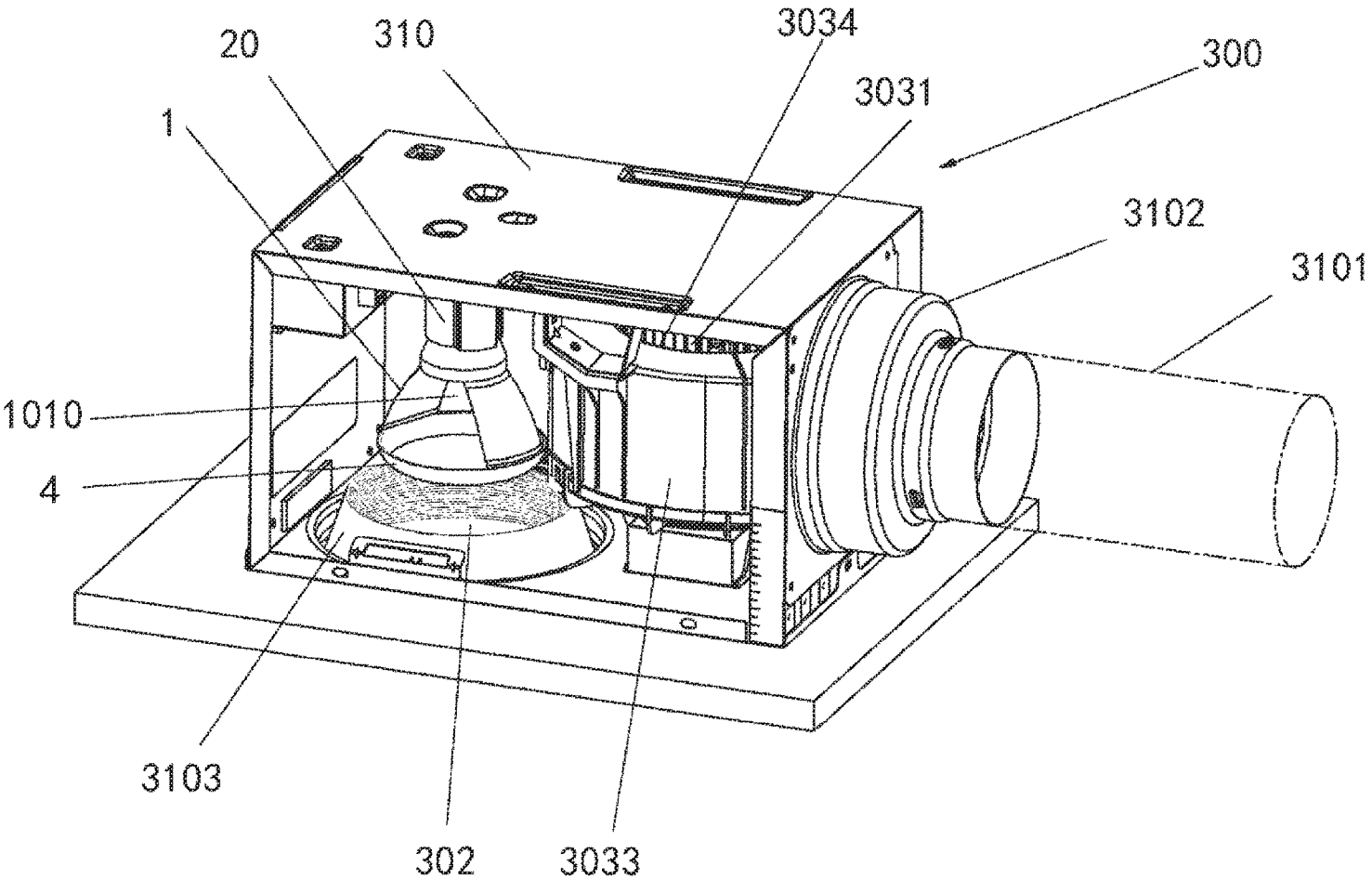
FIG. 2A is a schematic perspective view of a ceiling mounted airway device with illumination according to an embodiment of the present disclosure.
Figure 2B:
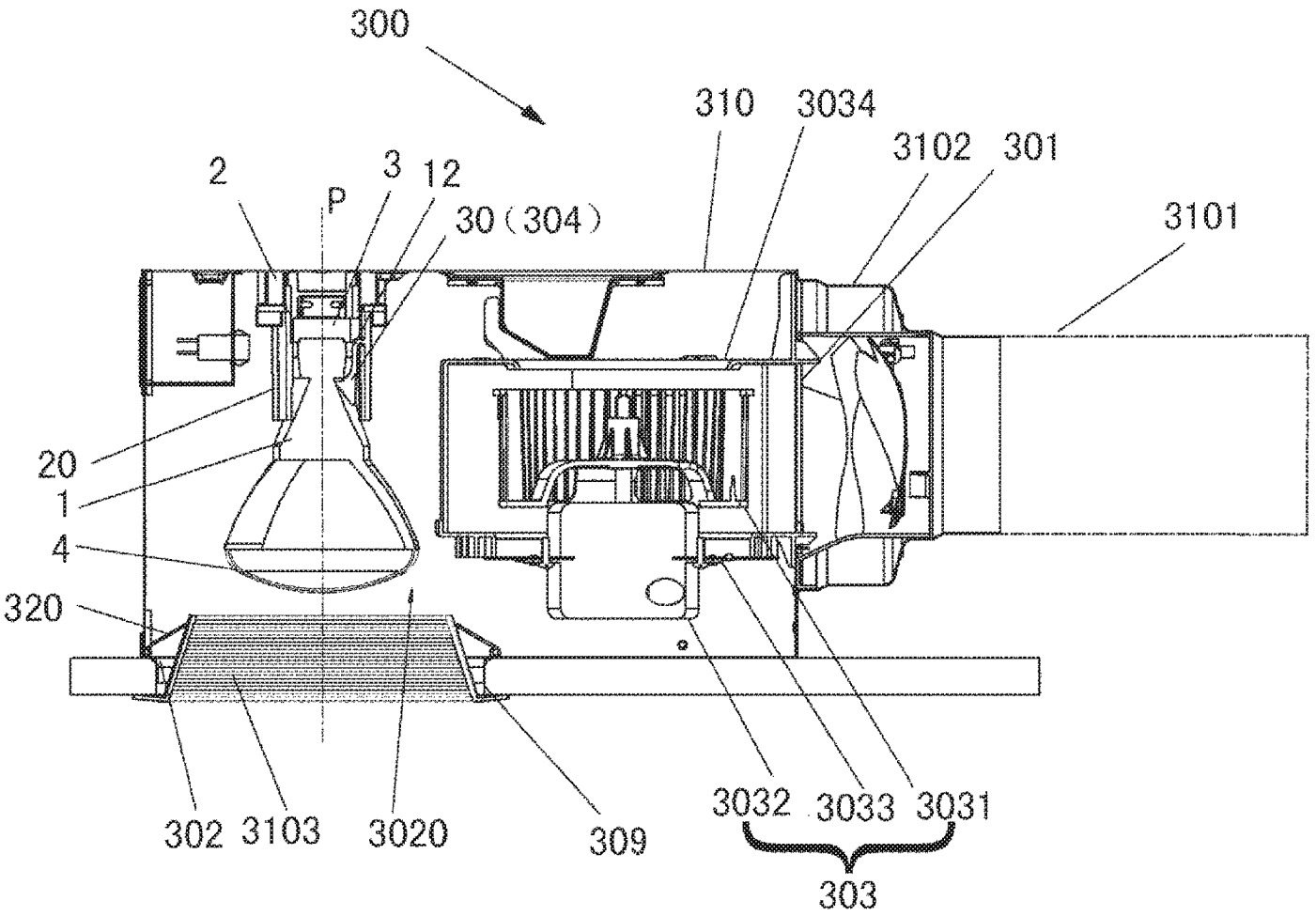
FIG. 2B is a cross sectional view of a ceiling mounted airway device with illumination according to an embodiment of the present disclosure.

The orientation or positional relationship indicated by the terms "upper", "lower", "top", "bottom" and the like in the scope of the specification and claims of the present disclosure is based on the fact that the orientation or positional relationship of various components when the main housing of FIGS. 2A and 2B is mounted on the ceiling. The terms that represent the orientation or positional relationship are merely for the purpose of facilitating and simplifying the description, and are not intended to indicate or imply that the means or elements referred must include a particular orientation and therefore cannot be understood as limitation to the present disclosure.

Figure 3:
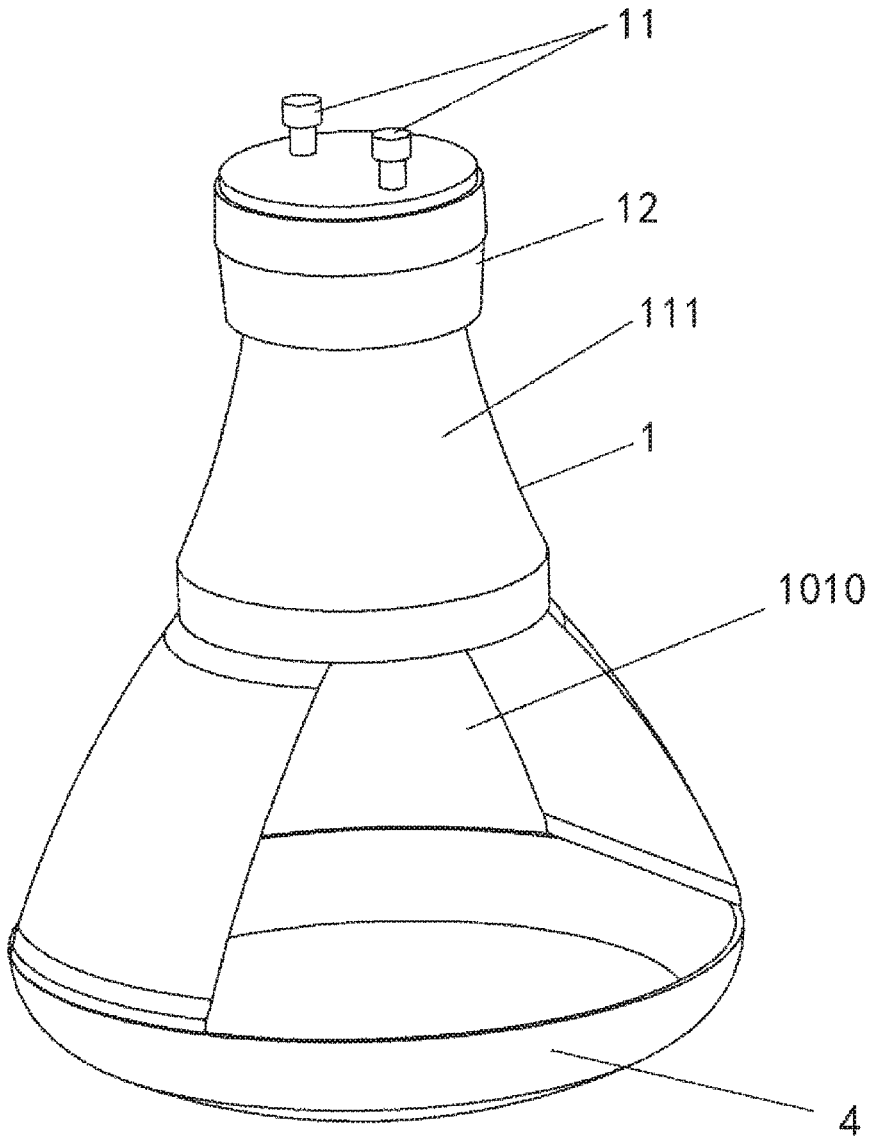
FIG. 3 is a schematic view of a lamp according to an embodiment of the present disclosure.
Figure 4:
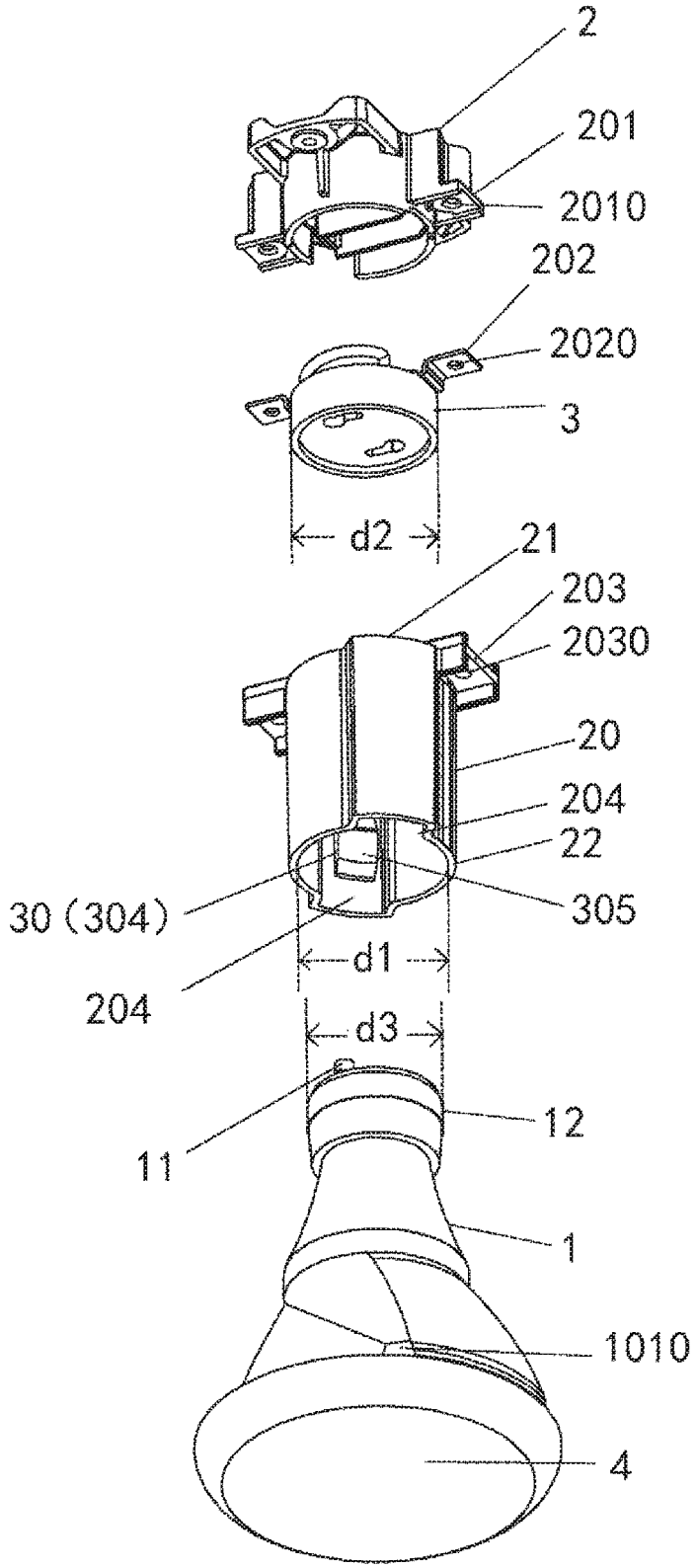
FIG. 4 is an exploded view of a lamp holder, a lamp fixing part, a shield and a lamp according to an embodiment of the present disclosure.
Figure 5A:
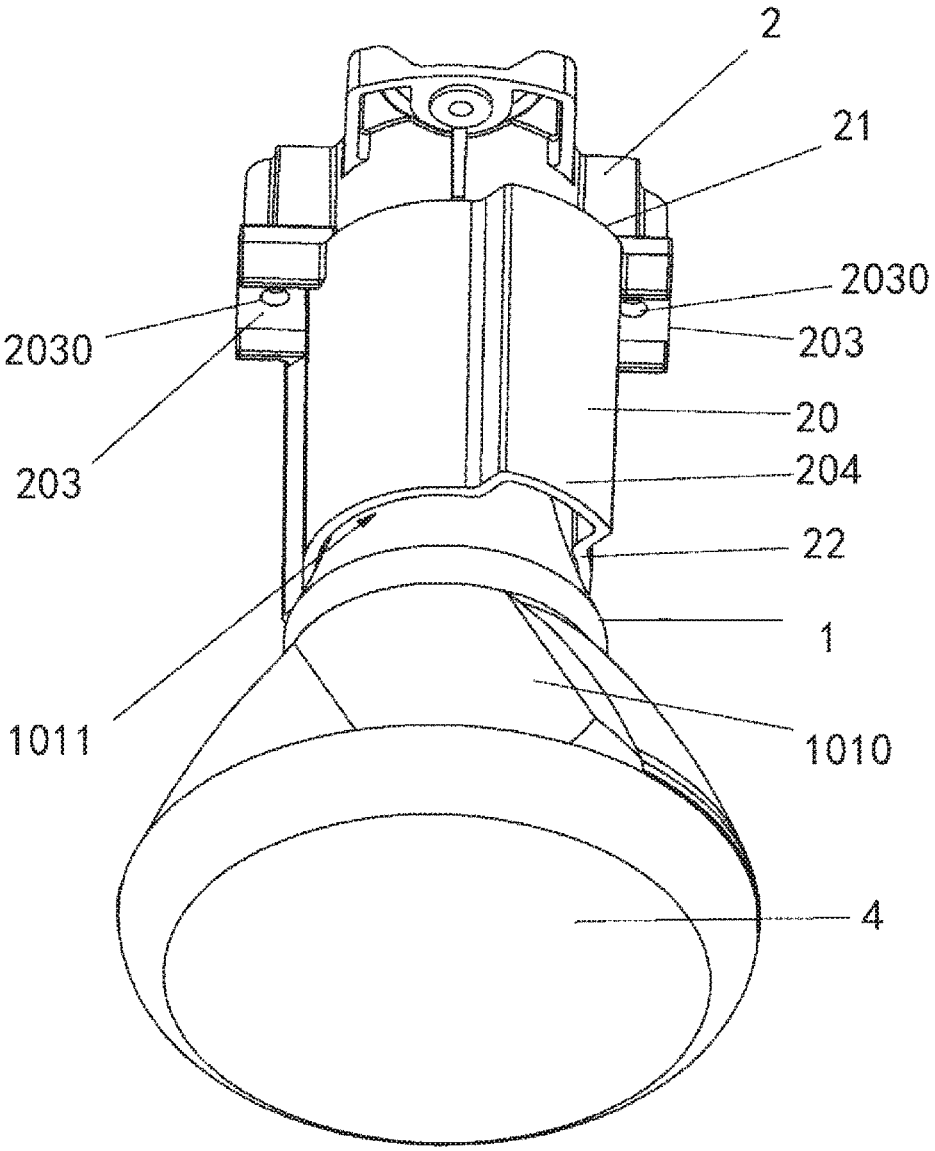
FIG. 5A is a schematic perspective view of a lamp holder, a lamp fixing part, a shield and a lamp according to an embodiment of the present disclosure in an assembled state.
Figure 5B:
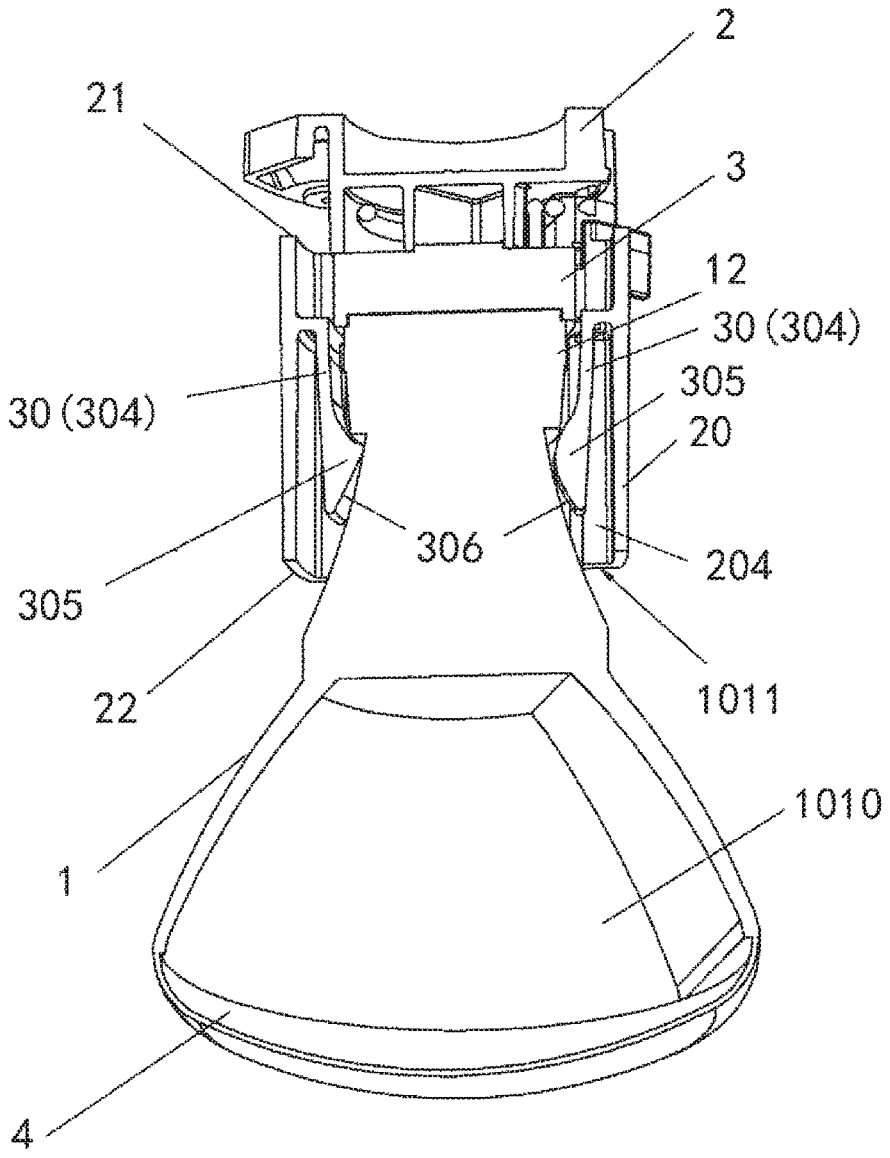
FIG. 5B is a cross sectional view of a lamp holder, a lamp fixing part, a shield and a lamp according to an embodiment of the present disclosure in an assembled state.
Figure 6A:
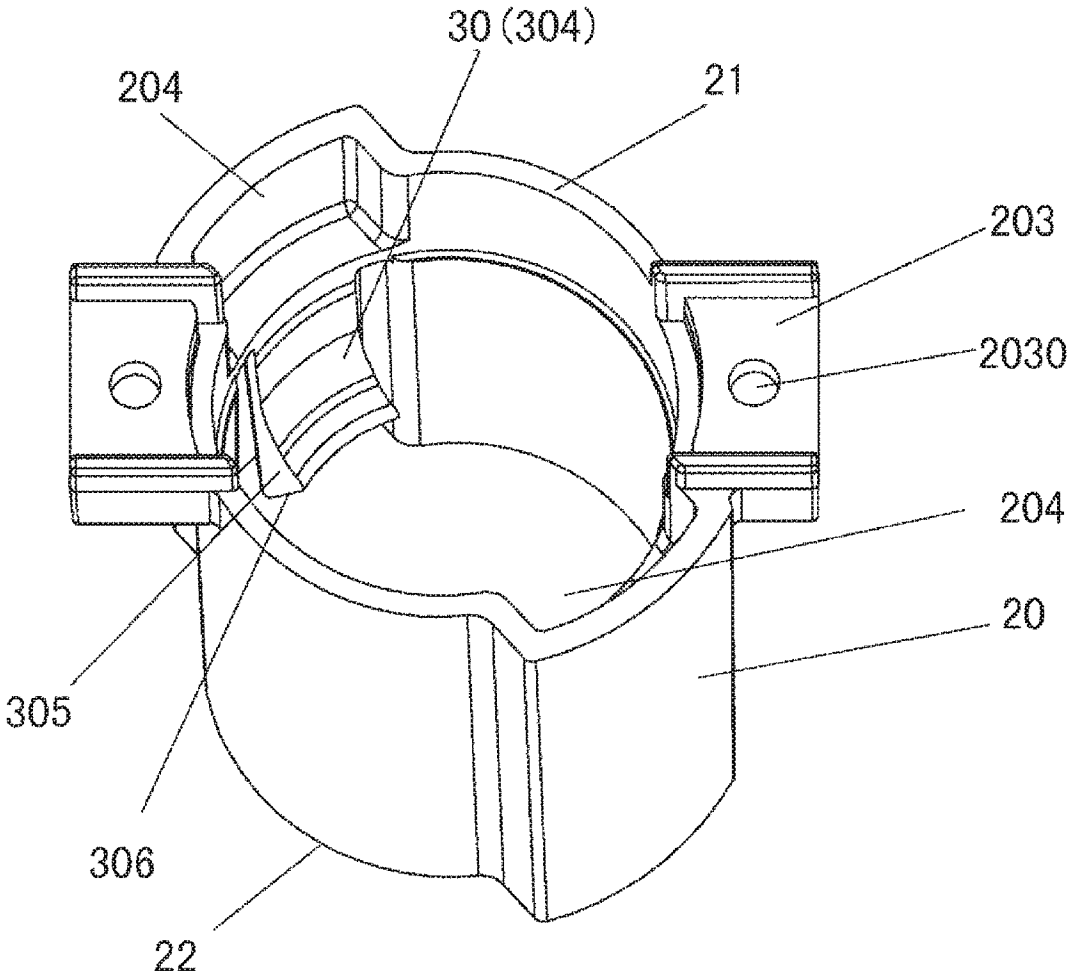
FIG. 6A is a top perspective view of a shield according to an embodiment of the present disclosure.
Figure 6B:
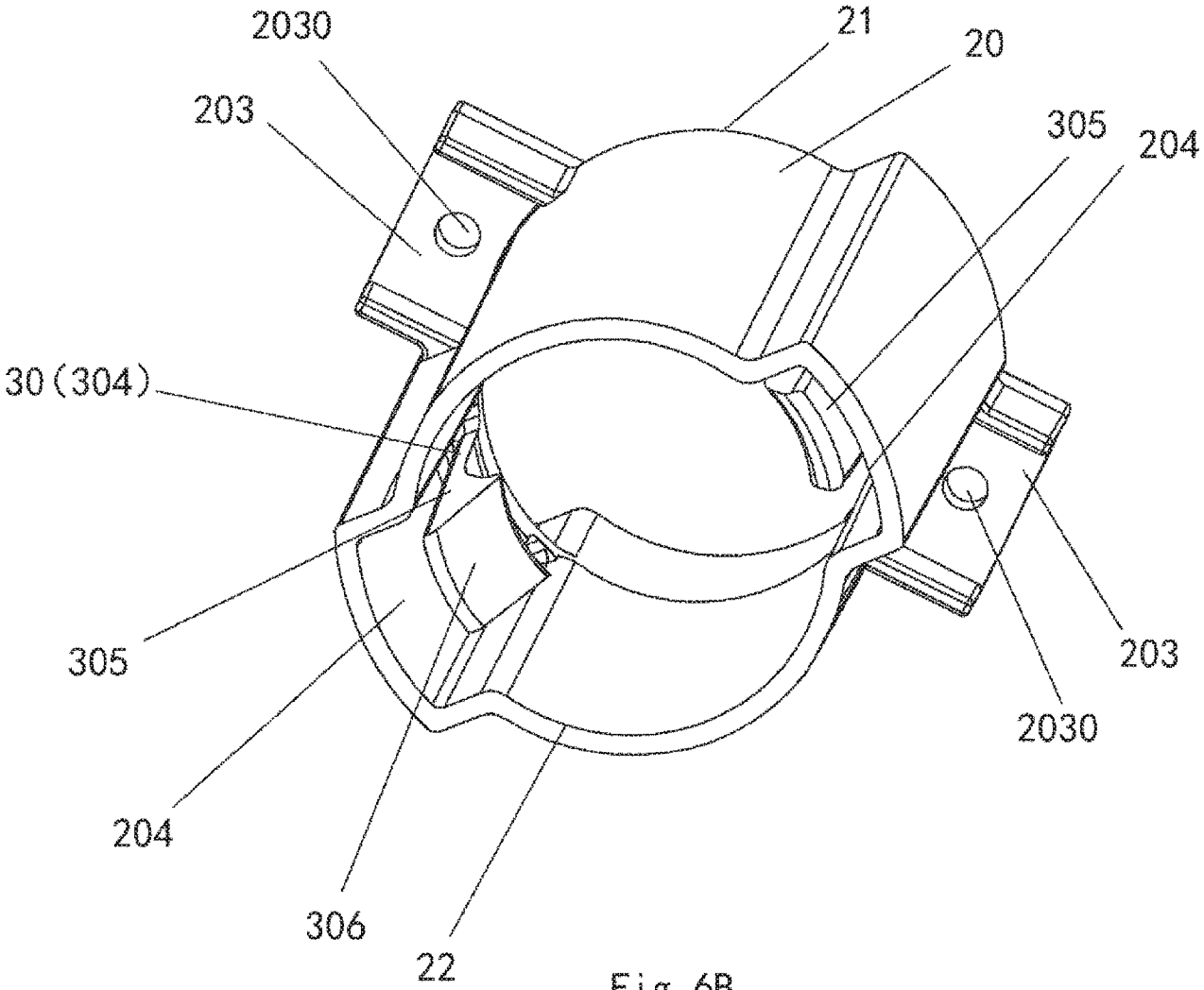
FIG. 6B is a bottom perspective view of a shield according to an embodiment of the present disclosure.

FIG. 2A is a schematic perspective view of a ceiling mounted airway device with illumination according to an embodiment of the present disclosure; FIG. 2B is a cross sectional view of a ceiling mounted airway device with illumination according to an embodiment of the present disclosure; FIG. 3 is a schematic view of a lamp according to an embodiment of the present disclosure; FIG. 4 is an exploded view of a lamp holder, a lamp fixing part, a shield and a lamp according to an embodiment of the present disclosure; FIG. 5A is a schematic perspective view of a lamp holder, a lamp fixing part, a shield and a lamp according to an embodiment of the present disclosure in an assembled state; FIG. 5B is a sectional view of a lamp holder, a lamp fixing part, a shield and a lamp according to an embodiment of the present disclosure in an assembled state; FIG. 6A is a top perspective view of a shield according to an embodiment of the present disclosure; and FIG. 6B is a bottom perspective view of a shield according to an embodiment of the present disclosure.

As shown in FIGS. 2A-6B, a ceiling mounted airway device with illumination 300 of the embodiment comprises a main housing 310, a lamp 1 and a lamp fixing part 3 which detachably fixes the lamp 1 to an inner wall of the main housing 310.

Specifically as shown in FIG. 3, the lamp 1 comprises an electrically conductive contact terminal 11 which is located at an upper end of the lamp 1 and may be electrically powered via the lamp fixing part 3.

The lamp 1 is provided with a flange 12 protruding from a surface 111 of the lamp 1 and located below the electrically conductive contact terminal 11. The ceiling mounted airway device with illumination 300 further comprises a shield 20 which is substantially in form of a cylinder and surrounds the electrically conductive contact terminal 11 and the lamp fixing part 3.

An upper end and a lower end of the shield 20 respectively form an upper end opening 21 and a lower end opening 22, and an inner diameter d1 of the shield 20 is larger than an outer diameter d3 of the flange 12 of the lamp 1. The lower end opening of the shield 20 is provided below the flange 12 of the lamp 1, and the shield 20 is provided with a support structure 30 for supporting the flange 12 of the lamp 1. A part of the support structure 30 is located below the flange 12 of the lamp 1 and is in contact with the flange 12 of the lamp 1 or is spaced apart from the flange 12 of the lamp 1 by a distance in a vertical direction. The support structure 30 can support the flange 12 of the lamp 1, when the lamp 1 is disengaged from the lamp fixing part 3. As shown in Figures, an example in which the flange 12 is formed on the surface of the lamp 1 and at upper part of the lamp 1 is illustrated, although the flange 12 may also be formed at other places of the lamp 1, for example, the surface of the middle or lower part. As compared with the situation that the flange 12 is formed on the surface of the middle part or lower part of the lamp 1, the flange 12 is formed at the upper part of the lamp 1, in this case, it is not necessary to set the lower end opening 12 of the shield 20 to be much low, and the shield 20 can be designed to be short. Therefore, the flange 12 being formed at the upper part of the lamp 1 is preferable.

The main housing 310 comprises: a first opening 301 for exhausting air out of the main housing 310, and a second opening 302 for sucking air into the main housing 310. The ceiling mounted airway device with illumination 300 further comprises a blower 303 for directing air from the second opening 302 to the first opening 301. The first opening 301 is in communication with the outdoor through a duct 3101.

The first opening 301 of the main housing 310 is formed at a side of the main housing 310 and is connected to a blow port of the blower 303 and a duct connecting portion 3102, and then is communicated with the duct 3101 via the duct connecting portion 3102 of. The second opening 302 is opened into the room. It is to be noted that an example in which the first opening 301 is formed at a side of the main housing 310 and the second opening 302 is formed in the lower part of the main housing 310 is illustrated. However, it is possible that the first opening 301 is formed in the upper part of the main housing 310.

The blower 303 comprises a fan 3031, a motor 3032 for rotating the fan 3031, a fan housing 3033 disposed in such a manner that it surrounds the fan 3031, and the blower 303 is fixed on the inner wall of the upper portion of the main housing 310. It should be noted that, as shown in the Figure, a suction port 3034 is formed in the fan housing 3033 of the blower 303 which is opened to the inner wall surface of the upper portion of the main housing 310 (that is, a suction port 3034 is provided so as to be opened toward the upper side of the Figure). However, it is possible that the suction port 3034 of the fan housing 3033 may be opened toward the inner wall surface of a lower portion of the main housing 310 or be opened in the direction towards the lamp 1.

The blower 303 is, for example, in a form of a centrifugal blower 303 such as a sirocco fan, but any other forms of blowers capable of realizing such an exhaust function may also be used.

As shown in FIG. 2B, an annular member, that is, a flange member 3103 (opening member), is mounted to a ceiling opening 309. The flange member 3103 has a decorative effect. The lower peripheral edge and the inner peripheral surface of the ceiling opening 309 are covered by the flange member 3103 to prevent the ceiling opening 309 from being viewed directly from the room. Further, one end of the flange member 3103 is engaged with the main housing 310 and the other end is mounted by a forcing member 320 (for example, a filament spring) engaged with the flange member 3103 in such a manner that the lower periphery of the ceiling opening 309 is urged upward. The forcing member 320 prevents the flange member 3103 from dropping when the flange member 3103 is disengaged from the ceiling opening 309.

An annular gap for air intake 3020 is provided between the lower end part of the lamp 1 and an edge part of the second opening 302 of the main housing 310, more specifically, the inner edge part of the flange member 3103. The indoor air is introduced into the main housing 310 through the second opening 302 and the annular gap for air intake 3020 to form an air introduction path of the ceiling mounted airway device with illumination 300.

In the ceiling mounted airway device with illumination 300 having such a construction, if the lamp 1 is turned on, the light emitted from the lamp 1 is introduced into the room through the ceiling opening 309 (the opening of the flange member 3103).

When the fan 3031 is driven to rotate by the motor 3032 of the blower 303, the indoor air is introduced into the main housing 310 through the second opening 302 and the annular gap for air intake 3020. The air introduced into the main housing 310 enters into the fan housing 3033 from the suction port 3034 which is opened upwardly and exhausts from the blower 303 through the first opening 301 and the duct connecting portion 3102 toward the duct 3101.

In addition to the so-called electrical bulb, the lamp 1 may be a fluorescent lamp, or an LED, or any other components for lighting, and the upper portion of the lamp 1 is provided with a flange 12 protruding from the surface of the lamp 1. The central position of the second opening 302 of the main housing 310 and the lamp 1 are aligned with each other in the vertical direction, although the arrangement of the lamp 1 and the second opening 302 of the main housing 310 is not limited to the above situation, as long as the light from the lame 1 can be irradiated into the indoor through the second opening 302.

As shown in FIG. 5B, a non-conductive lamp holder 2 is fixed between the lamp fixing part 3 and the inner wall surface of the upper portion of the main housing 310 in order to prevent the charged lamp fixing part 3 from being directly connected to the main housing body 310. The lamp 1 is mounted in the main housing 310 by inserting the electrically conductive contact terminal 11 at the upper end of the lamp 1 into the lamp fixing part 3 located below the lamp holder 2. A shield 20 is fixed to the lower portion of the lamp fixing part 3. The connection method of the lamp holder 2, the lamp fixing part 3 and the shield 20 will be described in detail as follows:

As shown in FIG. 4, the lamp holder 2 fixed to the inner wall of the upper portion of the main housing 310 is provided with at least two first projecting pieces 201, and each first protruding piece 201 is provided with a first hole 2010. At least two second protruding pieces 202 extend from the lamp fixing part 3 at the lower portion of the lamp holder 2 towards outside, and each second protruding piece 202 is provided with a second hole 2020.

The shield 20 is substantially in form of a cylinder. The upper and lower ends of the shield 20 are respectively formed with an upper end opening 21 and a lower end opening 22, and at least two third projecting pieces 203 extend from an outer wall in vicinity of the upper end opening 21 of the shield 20. Each third protruding piece 203 is provided with a third hole 2030. The first hole 2010, the second hole 2020, and the third hole 2030 are crimped by screws so that the lamp fixing part 3 and the shield 20 are fixed to the lamp holder 2. The connection method of the lamp fixing part 3, the shield 20 and the lamp holder 2 is not limited to the above-described way, and the connection methods known to those skilled in the art, such as mutual engagement, are also possible.

By providing the upper end opening 21 and the lower end opening 22 on the shield 20, the lamp 1 can be detachably attached to the lamp fixing part 3 below the lamp holder 2 through the lower end opening 22 and the upper end opening 21. The wall surface of the cylindrical shield 20 surrounds the electrically conductive contact terminal 11 at the upper end of the lamp 1 and the lamp fixing part 3 fixed below the lamp holder 2 to shield the gap between the electrically conductive contact terminal 11 and the lamp holder 3, so as to prevent water from being in contact with the live parts through the gap.

The lower opening 22 of the shield 20 is located below the flange 12 of the lamp 1, i.e. the shield 20 extends below the flange 12 of the lamp 1 by a length. The inner diameter d1 of the shield 20 is larger than the outer diameter d2 of the lamp fixing part 3 and larger than the outer diameter d3 of the flange 12 so that the electrically conductive contact terminal 11, the lamp fixing part 3 and the flange 12 of the lamp 1 can be contained in the shield 20.

The shield 20 is provided with a support structure 30 for supporting the flange 12 of the lamp 1 at a position below the flange 1 of the lamp 1. In the normal installation state of the lamp 1, the flange 12 of the lamp 1 and the support structure 30 may be in contact with each other, or may be spaced apart from each other by a distance in a vertical direction so as not to be in contact with each other. The support structure 30 on the shield 20 can support the flange 12 of the lamp 1 so that the lamp 1 cannot further fall down when the electrically conductive contact terminal 11 of the lamp 1 is released from the lamp fixing part 3, causing the lamp 1 to fall down (towards the indoor side).

Figure 8:
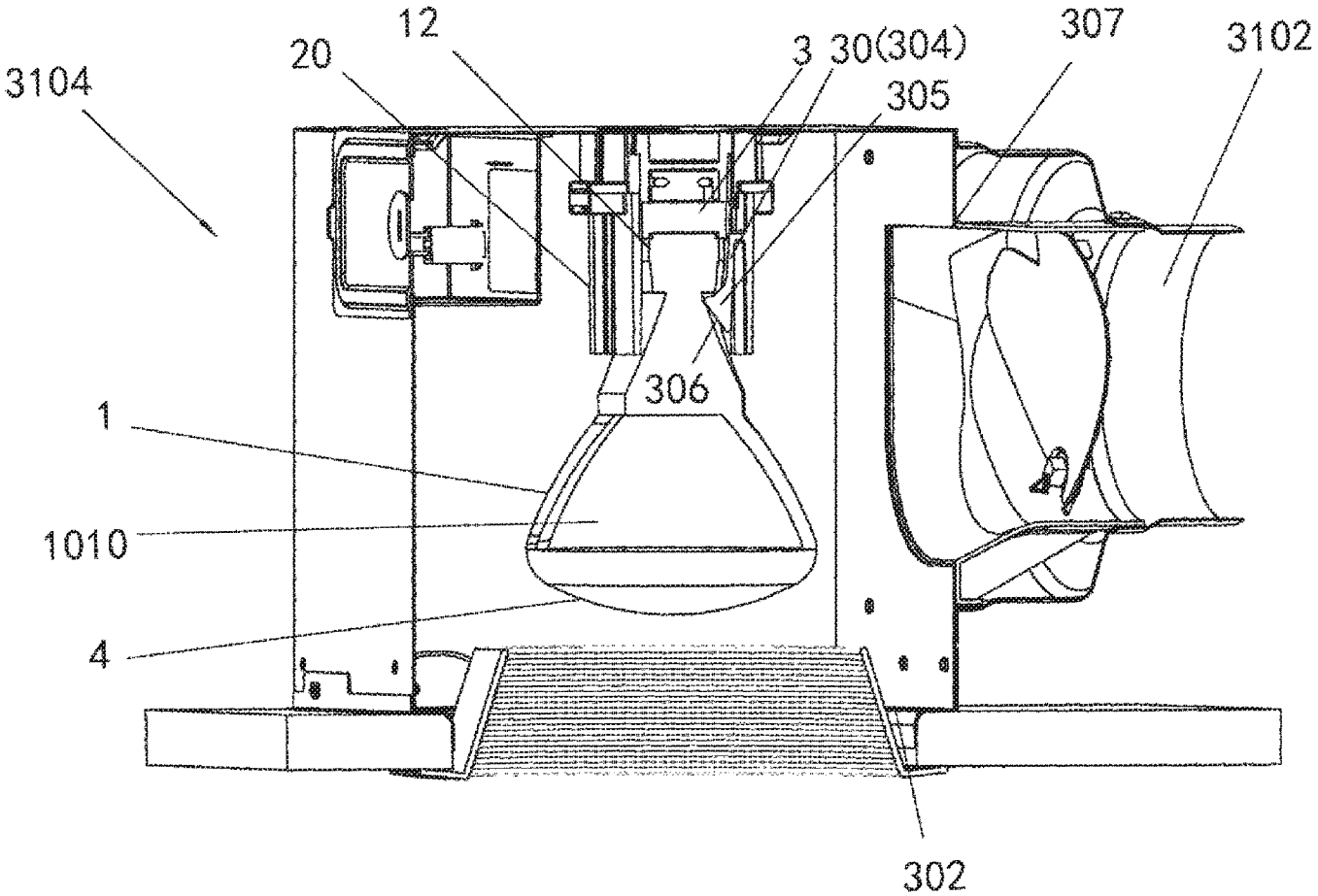
FIG. 8 is a cross sectional view of a first main housing of a ceiling mounted airway device with illumination according to another embodiment of the present disclosure.
Figure 9:
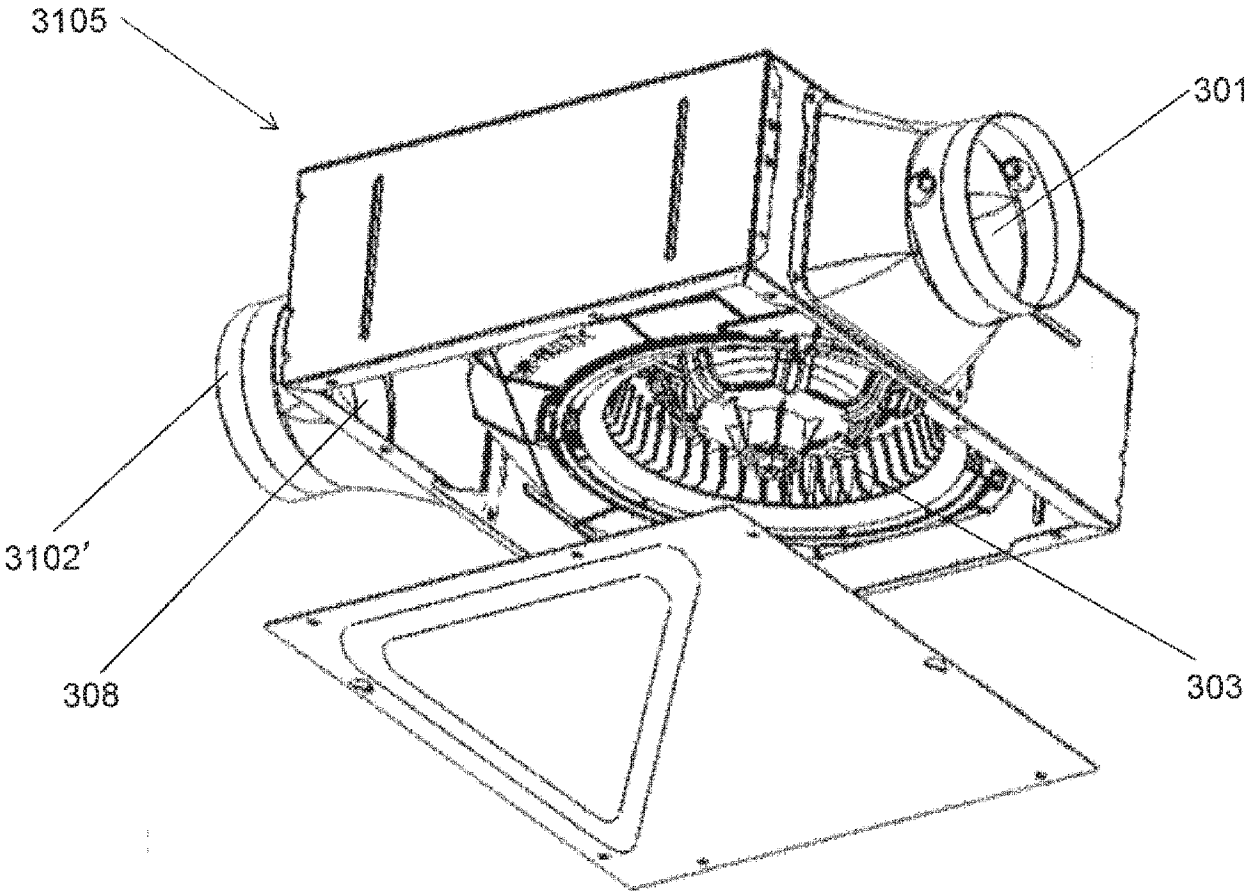
FIG. 9 is a schematic view of a second main housing of a ceiling mounted airway device with illumination according to another embodiment of the present disclosure.

In addition, the blower 303 and the lamp 1 are not limited to being provided in the same main housing 310. FIG. 8 is a cross sectional view of a first main housing of a ceiling mounted airway device with illumination according to another embodiment of the present disclosure; FIG. 9 is a schematic view of a second main housing of a ceiling mounted airway device with illumination according to another embodiment of the present disclosure. As shown in FIGS. 8 and 9, for example, the main housing 310 comprises a first main housing 3104 and a second main housing 3105. The first main housing 3104 comprises a lamp 1, a lamp fixing part 3 intended to detachably fix the lamp 1 to the inner wall of the first main housing 3104, and a shield 20 that surrounds the electrically conductive contact terminal (not shown in FIG. 8) and the lamp fixing part 3, a second opening 302 formed in the lower part, and a third opening 307 formed in the side. The second main housing 3105 comprises a blower 303, a first opening 301 connected to the blow port of the blower 303, and a fourth opening 308 connected to the third opening 307. At this time, in the ceiling mounted airway device with illumination 300, duct connecting portions 3102 and 3102' are respectively mounted at the third opening 307 of the first main housing 3104 with the lamp 1 and the fourth opening 308 of the second main housing 3105 with the blower 303, and the duct connecting portions 3102 and 3102' are connected by ducts. It is also possible to use ventilation such as a heat exchange device or a ventilation fan as the second main housing 3105 (as an example, a box-shaped blower is illustrated). In this way, the user can set up a ventilation or air supply machine which can realize other functions in the ceiling mounted airway device with illumination 300 according to the real requirement, so as to improve use flexibility.

It is not necessary to provide the blower 303 in the ceiling mounted airway device with illumination 300. For example, the blower 303 may be provided at the end of the duct 3101 connected to the ceiling mounted airway device with illumination 300 so that air can flow in the main housing 310 within the ceiling mounted airway device with illumination 300. Under this situation, the shield 20 can obtain the same effect.

Also as shown in FIG. 3, the flange 12 is annular. Since the flange 12 is annular, the support structure 30 can support the lamp regardless of the lamp 1 being rotated by any angle.

The lamp 1 is formed in a substantially truncated cone shape, and the diameter of the lower end portion of the lamp 1 is larger than the diameter of the upper end portion. A light emitting part 4 of the lamp 1 is located at the lower end portion of the lamp 1. In order to save the material of the lamp 1, a hollow part 1010 is provided between the lower end portion of the lamp 1 and the flange 12 of the lamp 1. The flange 12 is located between the shield 20 and the lamp 1.

Further as shown in FIGS. 2B and 5A, the center position of the shield 20 and the center position of the lamp 1 are aligned with each other in the vertical direction, i.e., the central axis of the shield 20 coincides with the central axis of the lamp 1. Here, the axis P passes through the center of the top and bottom surfaces of the cylindrical shield 20. There is a gap 1011 between the shield 20 and the lamp so as not to be in contact with each other, and the shield 20 does not interfere with the lamp 1 to ensure that the lamp 1 can be smoothly inserted into the shield 20 from the lower end opening 22 of the shield 20.

A gap 1011 is provided between the substantially cylindrical shield 20 and the lamp 1, and the center positions of the shield 20 and the lamp 1 are aligned with each other in the vertical direction so that the gap 1011 between the peripheral edge of the inner wall of the shield 20 and the outer periphery of the lamp 1 is rotationally symmetrical with respect to the axis P, and they are set to be close to but not in contact with each other. It is ensured that the lamp 1 is smoothly inserted into the shield 20 from the lower end opening 22 of the shield 20, while it prevents water from entering into the gap between the electrically conductive contact terminal 11 and the lamp fixing part 3 from the gap 1011 between the shield 20 and the lamp 1, due to the larger gap 1011 between the shield 20 and the lamp 1. That is, it prevents dust from being carried into the live parts or prevents water from being in contact with the live parts, avoiding short circuit and ensuring normal operation.

The flange 12 of the lamp 1 is located below the lamp fixing part 3. The lower end opening 22 of the shield 20 is located below the flange 12 of the lamp 1. The light emitting part 4 of the lamp 1 is located at the lower end of the lamp 1. The lower end opening 22 of the shield 20 is located above the light emitting part 4.

The flange 12 of the lamp 1 is located below the lamp fixing part 3, and the shield 20 surrounds the lamp fixing part 3, and even if water enters into the shield 20 from the gap 1011 between the lower end opening 22 of the shield 20 and the lamp 1, the flange 12 of the lamp 1 may serve to block the water from flowing up to the lamp fixing part 3, thereby enhancing the waterproofing effect.

The lamp 1 is in a form of a substantially truncated cone, and the light emitting part 4 of the lamp 1 is located at the lower end portion of the lamp 1. The lower end opening 22 of the shield 20 is located above the light emitting part 4, so that the shield 20 does not shield the light emitted from the light emitting part 4, ensuring that the indoor lighting effect is not affected by the shield 20.

As shown in FIGS. 5B, 6A and 6B, the side surface of the shield 20 is provided with a recess 204 recessed toward the outside of the shield 20, and the support structure 30 is integrally formed with the shield 20. The support structure 30 is an elastic tab 304 extending downwardly from the surface of the upper part of the recess 204 in the height direction of the shield 20. A lower end of the elastic tab 304 is formed with a hook 305 projecting toward the inside of the shield 20. The hook 305 has a guiding surface 306 extending from the lower end to the upper end and inclined toward the inside of the shield 20.

A side of the shield 20 is provided with a recess 204 recessed toward the outside of the shield 20, and the elastic tab 304 is integrally formed with the shield 20. That is, the elastic tab 304 extends downwardly from the inner wall surface of the upper portion of the recess 204 in the height direction of the shield 20. The hook 305 protruding toward the inner side of the shield 20 is formed at the lower end of the elastic tab 304. Therefore, when the lamp 1 is inserted into the lamp fixing part 3 below the light holder 2 through the shield 20, the flange 12 at the upper portion of the lamp 1 urges the hook 305 at the lower end of the elastic tab 304 so that the elastic tab 304 is elastically deformed and moves towards the recess 204, that is, the recess 204 provides a space for the outward movement of the tab 304. After the flange 12 of the lamp 1 passes over the hook 305, the hook 305 is no longer pressed by the flange 12 and restores its original shape so as to support the flange 12 at the bottom of the flange 12 of the lamp 1.

Figure 7:
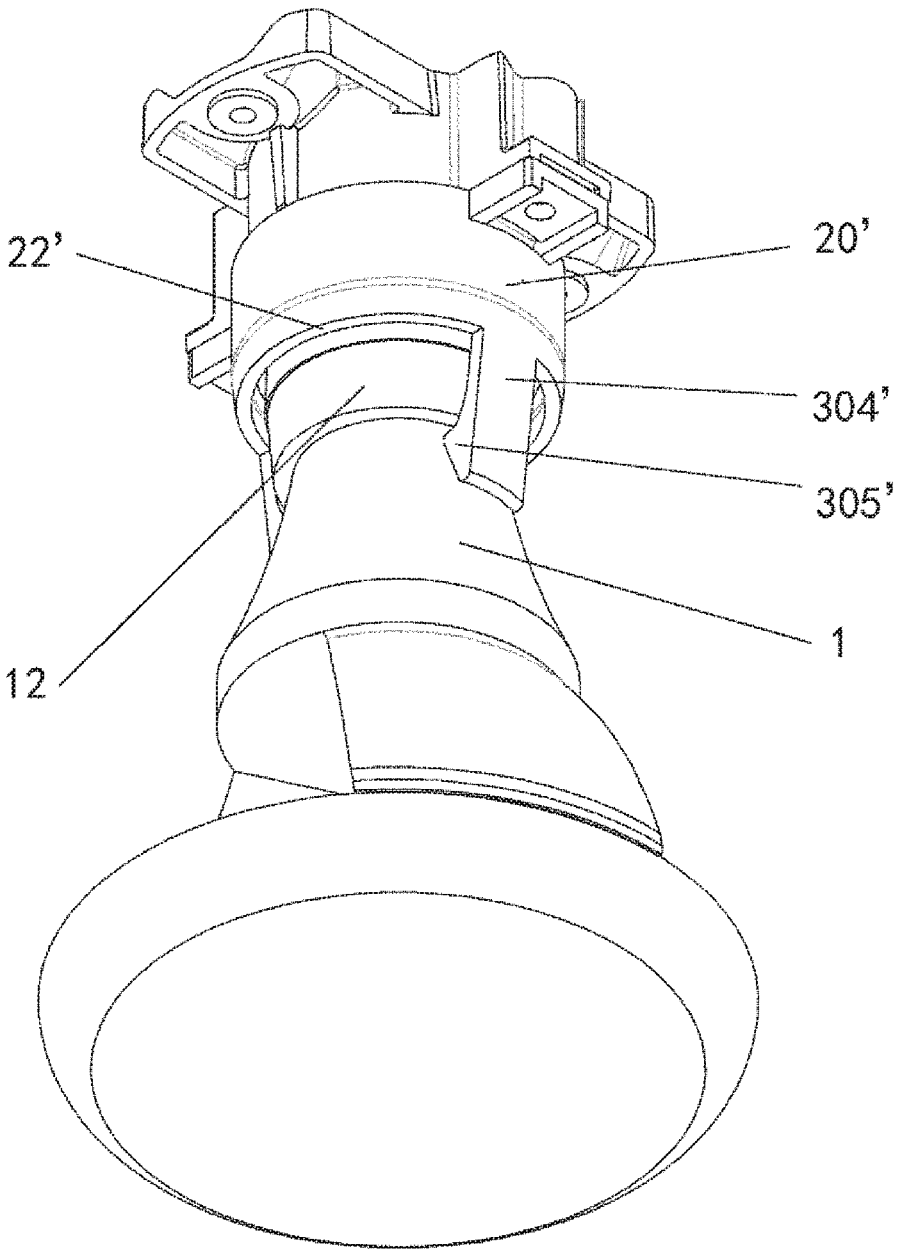
FIG. 7 is a schematic perspective view of a lamp holder, a lamp fixing part, a shield and a lamp according to another embodiment of the present disclosure in an assembled state.

It is also possible to reduce the height of the shield 20 so that the length of the shield 20 in the vertical direction is smaller than the length of the elastic tab 304. FIG. 7 is a schematic perspective view of a lamp holder, a lamp fixing part, a shield and a lamp according to another embodiment of the present disclosure in an assembled state. As shown in FIG. 7, the support structure is an elastic tab 304' protruding towards the inside of the shield from the lower end of the shield 20' or the inner wall of the middle portion of the shield 20' and extending downwardly in the length direction of the shield 20'. The hook 305' is located below the lower end opening 22' of the shield 20' such that the flange 12 at the upper portion of the lamp 1 urges the hook 305' at the lower end of the elastic tab 304' when the lamp 1 is inserted into the lamp fixing part 3 below the lamp holder 2 through the shield 20', and the elastic tab 304 ' may elastically deform to move towards the outer space, that is to say, the space below the lower end opening 22' of the shield 20' provides a space for the outward movement of the tab 304'.

Also as shown in FIGS. 5B, 6A and 6B, since the hook 305 has a guiding surface 306 extending from the lower end to the upper end and inclined toward the inside of the shield 20, when the lamp 1 is inserted into the lamp fixing part 3 through the shield 20, the flange 12 of the lamp 1 firstly comes into contact with the lower end of the guiding surface 306 and continues to slide upwardly along the inclined guiding surface 306 into the housing 20. That is to say, the guide surface 306 can serve as a guiding means to allow the flange 12 of the lamp 1 to smoothly pass over the hook 305.

When the electrically conductive contact terminal 11 of the lamp 1 is released from the lamp fixing part 3, causing the lamp 1 to fall down (towards the indoor side), the hook 305 can support the flange 12 of the lamp 1 so that the lamp 1 cannot continue to fall down (towards the indoor side), which prevents the lamp 1 from falling down and being damaged, and improves the safety of the ceiling mounted airway device with illumination.

When the lamp 1 is needed to be replaced, the hand holds the lamp 1 and applies a force downward so that the flange 12 of the lamp 1 presses the hook 305, and the elastic tab 304 is elastically deformed and moves into the recess 204 so as to be accommodated in the recess 204. At this time, the hook 305 no longer supports the flange 1 of the lamp 1, and the lamp 1 can be smoothly taken out, which may facilitate mounting and removing of the lamp 1, and prevent the lamp 1 from falling down.

In the embodiment, the upper end of the hook 305 is in contact with the flange 12 of the lamp 1. If the hook 305 is provided to be spaced apart from the flange 12 of the lamp 1 by a distance in the vertical direction, then the hook 305 may still support the flange 12 when the lamp 1 is released. However, under this situation, the lamp 1 will fall down by a certain distance until it comes into contact with the hook 305, thus, the impact force generated by the falling down may cause the hook 305 to move toward the recess 204 such that the hook 305 loses the function of supporting the lamp 1. Therefore, it is a preferred solution that the upper end of the hook 305 and the flange 12 of the lamp 1 are in contact with each other. When the lamp 1 is released, the hook 305 directly supports the flange 12 of the lamp 1 so that the lamp 1 cannot fall down. In this way, it is possible to further prevent the lamp 1 from falling down.

The number of the elastic tabs 304 is at least two, and the number of the recesses 204 is equal to the number of the elastic tabs 304, that is at least two. By increasing the number of the elastic tabs 304 and the recesses 204, the protection function is enhanced. In this way, it is possible to further prevent the lamp 1 from falling down.

In the embodiment, the number of the elastic tabs 304 is two, and the two elastic tabs 304 are disposed opposite to each other, and aligned with each other at the position in the height direction of the shield 20. With the above-described structure, the recesses 204 and the hooks 305 of the two elastic tabs 304 are also respectively disposed opposite to each other, and aligned with each other at the position in the height direction of the shield 20. When the lamp 1 is inserted into the lamp fixing part 3 below the lamp holder 2 through the shield 20, the lamp 1 will not incline due to the pressure of the hook 305 of the tab 304 at one side, but is always coincide with the center of the shield 20 in the vertical direction.

When the electrically conductive contact terminal 11 of the lamp 1 is released from the lamp fixing part 3 to cause the lamp 1 to fall down (towards the indoor side), the two opposing hooks 305 support the lamp 1 in two opposite directions, preventing the lamp 1 from being inclined and falling down from the space between the hook 305 at one side and the shield 20, further preventing the lamp 1 from falling down.

Figure 10:
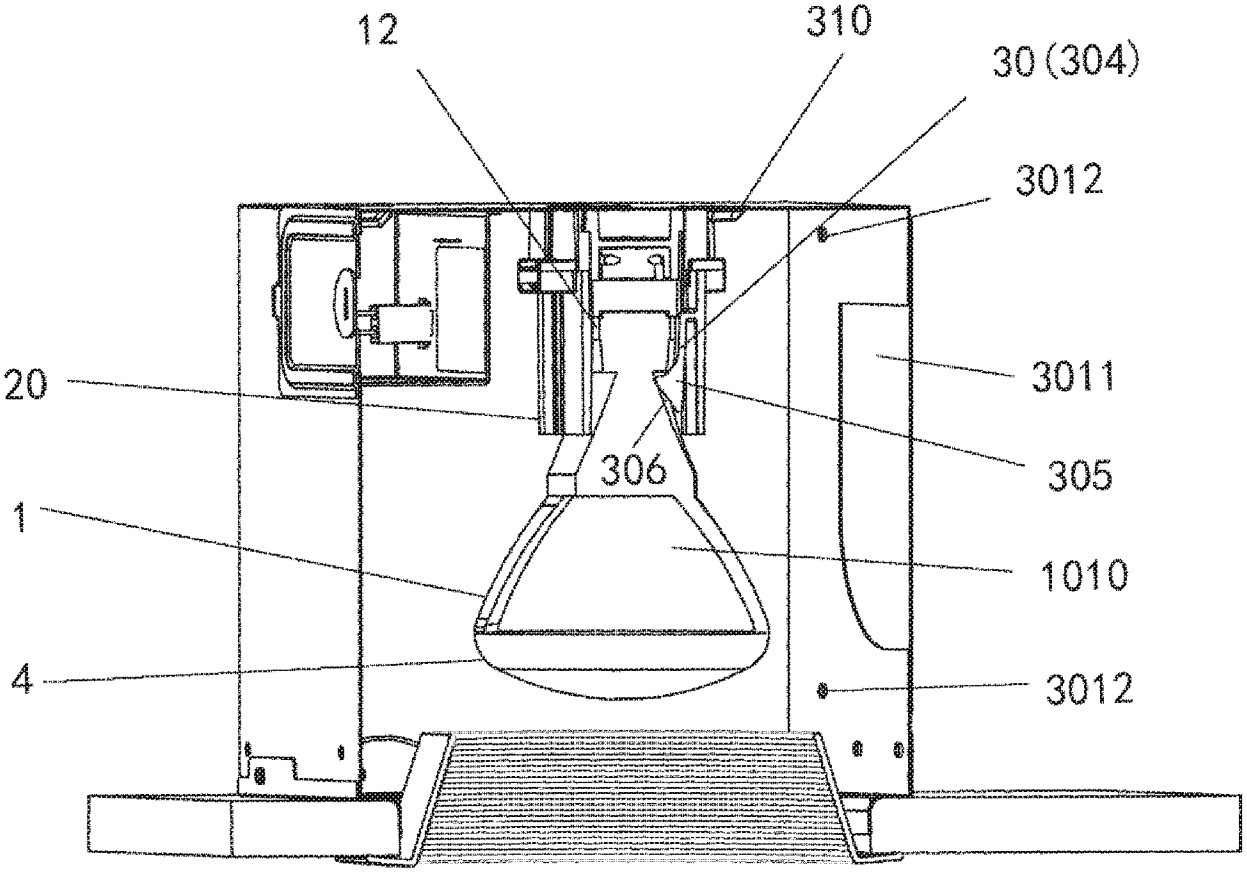
FIG. 10 is a cross sectional view of a ceiling mounted airway device with illumination according to another embodiment of the present disclosure.

FIG. 10 is a cross sectional view of a ceiling mounted airway device with illumination according to another embodiment of the present disclosure. As shown in FIG. 10, the main housing 310 comprises a light shielding plate 3011 for covering the first opening 301 and a light shielding plate fixing part 3012 for fixing the light shielding plate 3011. The light shielding plate 3011 covering the first opening 301 is fixed to the light shielding plate fixing part 3012.

The so-called light shielding plate fixing part 3012 may be any member as long as it may fix the light shielding plate 3011, for example, a screw hole. By installing a light shielding plate 3011 covering the first opening 301, it prevents entry of external insects or the like, and the main housing 310 can be used as a separate lamp product. In addition, as the first opening 301 is covered by the light shielding plate 3011, the light from the lamp 1 may be irradiated into the room without leakage from the first opening 301, which improves the brightness of indoor lighting.

The foregoing is merely a specific embodiment of the present disclosure, but the protection scope of the present disclosure is not limited thereto. Any modifications or alternations which are obvious to those skilled in the art are covered by the protection scope of the present disclosure. Accordingly, the protection scope of the present disclosure is defined in the claims and their equivalents.

What is claimed is:

1. A ceiling mounted airway device with illumination, comprising a main housing, a lamp and a lamp fixing part intended to detachably fix the lamp to an inner wall of the main housing, wherein the main housing comprises:

a first opening for exhausting air out of the main housing; and a second opening for sucking air into the main housing, and the lamp comprises:

an electrically conductive contact terminal which is located at an upper end of the lamp and electrically powered via the lamp fixing part; and a flange protruding from a surface of the lamp and located below the electrically conductive contact terminal, wherein the ceiling mounted airway device with illumination further comprises a shield for supporting the flange, which is substantially in form of a cylinder and surrounds the electrically conductive contact terminal and the lamp fixing part.

2. The ceiling mounted airway device with illumination according to claim 1, wherein an upper end and a lower end of the shield respectively form an upper end opening and a lower end opening, an inner diameter of the shield is larger than an outer diameter of the flange of the lamp, the lower end opening of the shield is provided below the flange of the lamp, and the shield is provided with a support structure for supporting the flange of the lamp.

3. The ceiling mounted airway device with illumination according to claim 1, wherein the flange is annular.

4. The ceiling mounted airway device with illumination according to claim 1, wherein a central axis of the shield coincides with an central axis of the lamp.

5. The ceiling mounted airway device with illumination according to claim 1, wherein the flange of the lamp is located below the lamp fixing part and the lower end opening of the shield is located below the flange of the lamp, a light emitting part of the lamp is located at a lower end of the lamp, and the lower end opening of the shield is located above the light emitting part.

6. The ceiling mounted airway device with illumination according to claim 2, wherein the support structure is integrally formed with the shield, and the support structure comprises an elastic tab projecting from the lower end of the shield or from a middle part of an inner wall of the shield toward the inside of the shield and extending downwardly in a height direction of the shield, a lower end of the elastic tab is provided with a hook projecting toward the inside of the shield.

7. The ceiling mounted airway device with illumination according to claim 2, wherein a lateral surface of the shield is provided with a recess recessed toward the outside of the shield, the support structure is integrally formed with the shield, and the support structure comprises an elastic tab projecting downward from an upper part of an inner wall of the recess in a height direction of the shield, a lower end of the elastic tab is provided with a hook projecting toward the inside of the shield, the elastic tab is elastically deformable to move towards the recess so as to be received therein.

8. The ceiling mounted airway device with illumination according to claim 6, wherein the hook is located below the flange of the lamp, and configured to be made contact with the flange of the lamp or spaced apart from the flange of the lamp by a certain distance in a vertical direction.

9. The ceiling mounted airway device with illumination according to claim 7, wherein the hook comprises a guide surface extending from a lower end to an upper end thereof and inclined toward the inside of the shield.

10. The ceiling mounted airway device with illumination according to claim 7, wherein an upper end of the hook is configured to be made contact with the flange of the lamp.

11. The ceiling mounted airway device with illumination according to claim 7, wherein the number of the elastic tab is at least two, and the number of the recesses is equal to that of the elastic tab.

12. The ceiling mounted airway device with illumination according to claim 7, wherein the number of the tab is two, and the two elastic tabs are arranged symmetrically with respect to a central axis of the shield.

13. The ceiling mounted airway device with illumination according to claim 1, wherein the ceiling mounted airway device with illumination further comprises a blower for directing air from the second opening to the first opening.

14. The ceiling mounted airway device with illumination according to claim 1, wherein the first opening is in communication with the outdoor through a duct.

15. The ceiling mounted airway device with illumination according to claim 1, wherein the main housing comprises a light shielding plate for covering the first opening and a light shielding plate fixing part for fixing the light shielding plate.

16. The ceiling mounted airway device with illumination according to claim 1, wherein the second opening is provided below the main housing, an annular flange member is provided on the second opening, and an annular gap for air intake is provided between the lower end of the lamp and an inner edge of the flange member, air inside the room is guided into the main housing through the second opening and the annular gap for air intake.

17. The ceiling mounted airway device with illumination according to claim 16, wherein a length from an end to the other end of the inner edge of the flange member in a horizontal direction is shorter than a length from an end to the other end of the lamp in a horizontal direction.

18. The ceiling mounted airway device with illumination according to claim 7, wherein the hook is located below the flange of the lamp, and configured to be made contact with the flange of the lamp or spaced apart from the flange of the lamp by a certain distance in a vertical direction.

* * * * *